United States Patent [19]

Bennett

[11] 4,119,264

[45] Oct. 10, 1978

[54] CONTAINER DIVIDER AND DISPENSING ASSEMBLY

[75] Inventor: James A. Bennett, Mequon, Wis.

[73] Assignee: Will Ross, Inc., Milwaukee, Wis.

[21] Appl. No.: 763,474

[22] Filed: Jan. 28, 1977

[51] Int. Cl.[2] ..... B65D 5/48; B65D 85/08

[52] U.S. Cl. ..... 229/15; 221/34; 221/63; 229/42

[58] Field of Search ..... 221/33, 34, 45-63, 221/305; 229/15, 42

[56] References Cited

U.S. PATENT DOCUMENTS

| | | | |
|---|---|---|---|
| 2,706,066 | 4/1955 | Wells | 221/305 X |
| 3,003,207 | 10/1961 | Powers | 229/40 X |
| 3,101,880 | 8/1963 | Peterson | 229/15 |
| 3,599,800 | 8/1971 | Durante | 221/47 X |
| 3,963,171 | 6/1976 | Lindsay | 229/42 |
| 3,982,684 | 9/1976 | David | 229/15 |

*Primary Examiner*—Robert B. Reeves
*Assistant Examiner*—Francis J. Bartuska
*Attorney, Agent, or Firm*—John A. Dhuey

[57] ABSTRACT

A container divider is described which is formed from a single blank of foldable sheet material. The divider is adapted to be used with containers for storage of tubular materials which are to be retained in a curved configuration during storage. Additionally, the divider and container assembly provide a dispensing container for unitary dispensation of the tubular articles. The divider can be automatically set up for insertion in the container by a simple folding operation.

5 Claims, 8 Drawing Figures

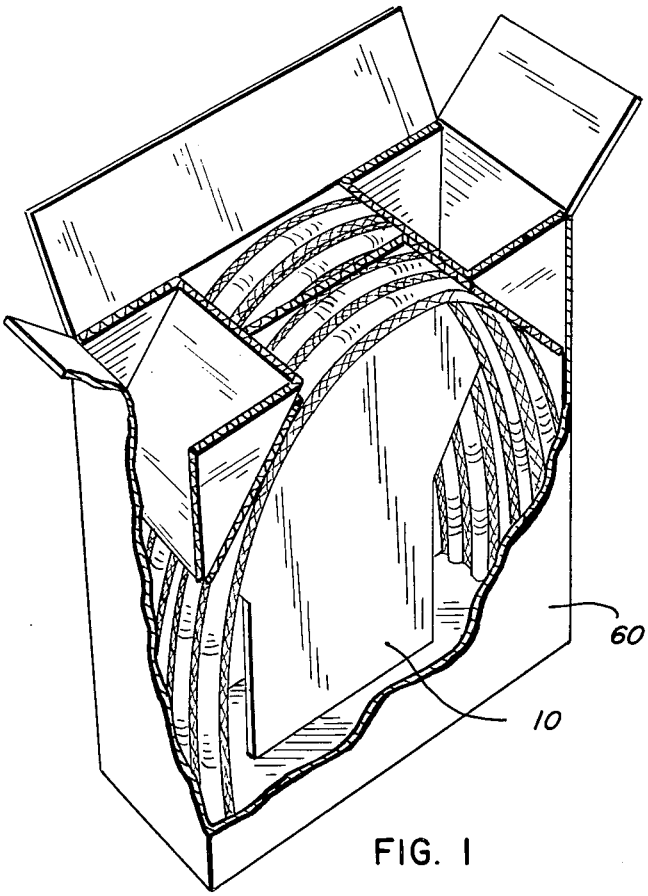
FIG. 1
FIG. 2
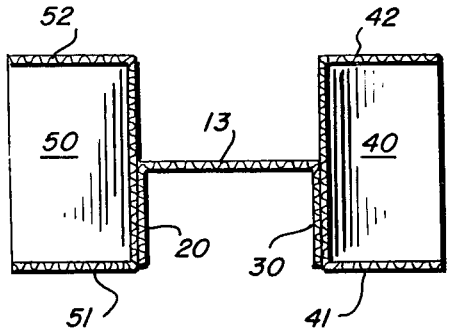
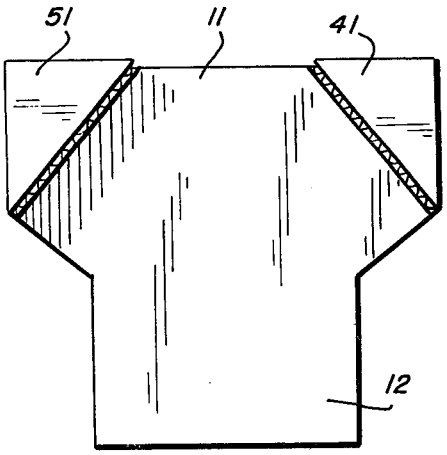
FIG. 3
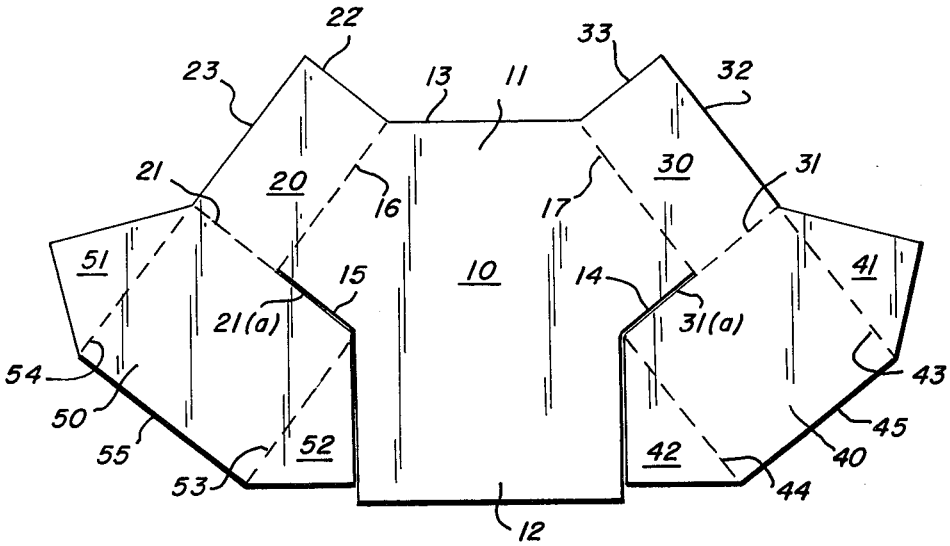
FIG. 4

FIG. 5
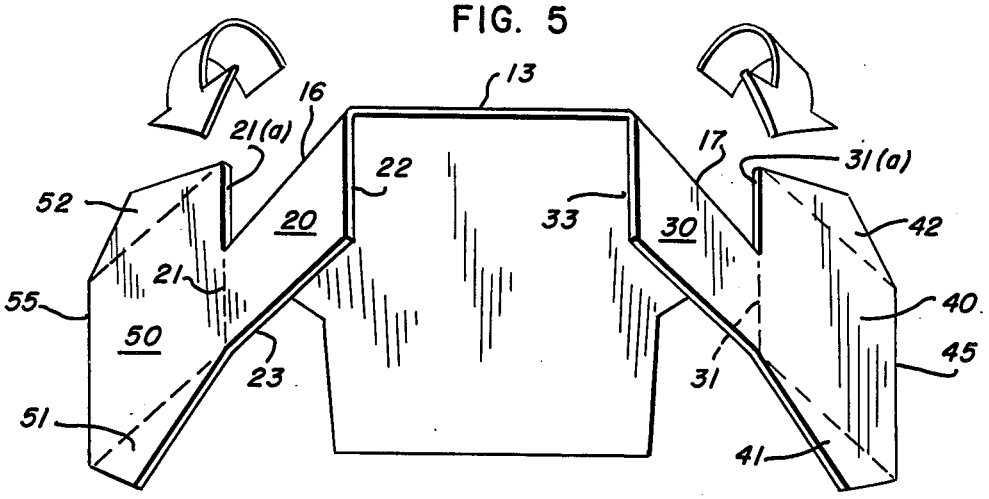
FIG. 6
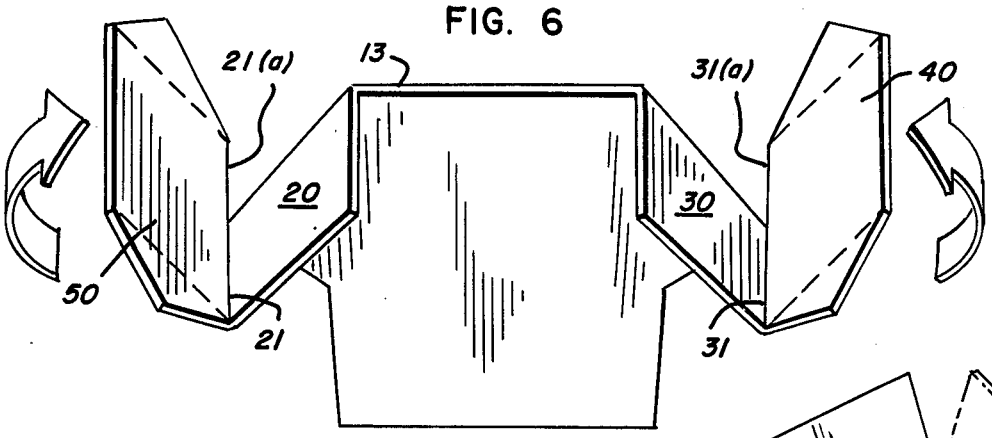
FIG. 7
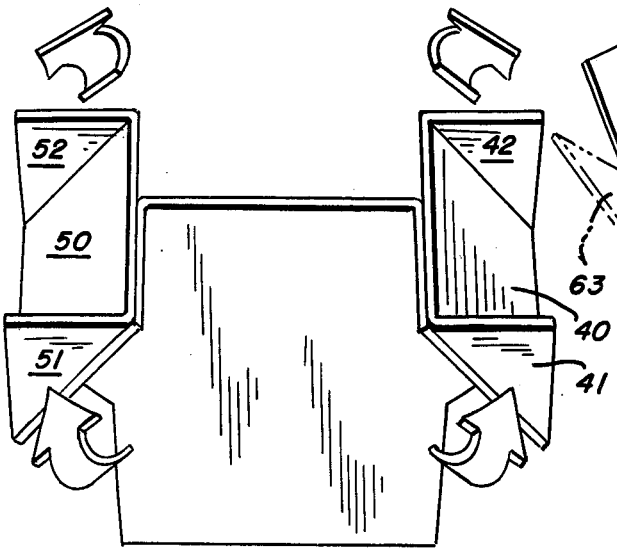
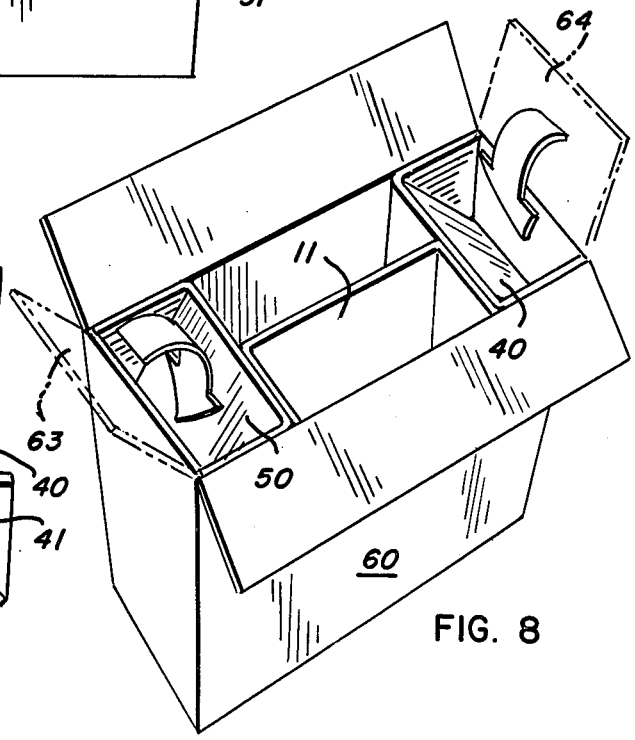
FIG. 8

CONTAINER DIVIDER AND DISPENSING ASSEMBLY

SUMMARY OF THE INVENTION

The invention relates generally to dividers to be used in containers. In particular, the invention relates to a divider which can be formed from a single sheet of foldable material and which, when folded, provides a compartmentalized arrangement in the container. Furthermore, the design permits tubular articles which are to be retained in a curved configuration to be stored for long periods of time within the container without losing their curvature. These articles may be dispensed one by one from the container without disturbing the other articles and without impairing retention of curvature.

Various tubular articles, for example endotracheal tubes, are manufactured with an inherent degree of curvature. Storage of such articles presents a problem in that the particular plastic materials from which the articles are manufactured and the methods of manufacture tend to cause the articles to revert somewhat to straightened configuration. This is particularly troublesome when such articles must be stored over long periods of time. Due to the curved nature of endotracheal tubes, it is difficult to store them in a compact configuration. Also, the curved article does not lend itself to convenient dispensing on a one by one basis.

In order to correct the above-noted problems, there is described herein a divider formed of a single sheet of foldable material which provides for storage of curved tubular articles with retention of configuration and also provides, in combination with an appropriately sized container, a convenient dispensing device.

DESCRIPTION OF THE DRAWINGS

FIG. 1 is a perspective view of the divider and container of this invention;

FIG. 2 is a top view of the container divider in its folded configuration;

FIG. 3 is a front view of the container divider in its folded configuration;

FIG. 4 is a plan view of the container divider blank in its unfolded configuration;

FIGS. 5, 6 and 7 are perspective views of the blank illustrating the folding sequence; and FIG. 8 is a perspective view of the divider placed within the container illustrating the last folding operation of the container and flaps to provide a dispensing container.

DESCRIPTION OF THE PREFERRED EMBODIMENTS

Referring first to FIG. 4, the container divider of this invention can be formed from a single blank 10 of foldable sheet material, e.g. double-faced corrugated fiber board. Blank 10 is formed of a central portion 11 having a rearwardly directed portion 12. Central portion 11 has free edges 13, 14 and 15 and fold edges 16 and 17. Free edge 13 is opposed from rearward extension 12 and free edges 14 and 15 are adjacent to extension 12. A pair of front panels 20 and 30 are foldably connected at edges 16 and 17 of central portion 11. For forming purposes fold lines 16 and 17 are generally scored before the folding operation is completed. Panels 20 and 30 are foldable in a position perpendicular to central portion 11 as shown in FIG. 5. Attached to side edges 21 and 31 of front panels 20 and 30, respectively, are a pair of side support panels 40 and 50. Panel 50 is foldably connected to front panel 20 at fold line 21 and panel 40 is foldably connected to panel 30 at fold line 31. Again, fold lines 21 and 31 are preferably scored before the folding operation is commenced. Panels 40 and 50 are adapted to be folded inwardly upon front panels 20 and 30 as shown most specifically in FIGS. 6 and 7. Panels 40 and 50 have free edges 31(*a*) and 21 (*a*), which abut free edges 14 and 15 of central portion 11.

In a preferred embodiment of this invention, side support panels 40 and 50 have tabular extensions 41, 42, 51, 52 which are foldably joined to side support panels 40 and 50. Tabular extensions 51 and 52 are foldably connected by fold lines 53 and 54, respectively, to panel 50. Fold lines 53 and 54 are perpendicular to free edge 15. Also in a like manner, tabular extensions 41 and 42 are connected to panel 40 by fold lines 43 and 44, respectively, which are perpendicular to free edge 14.

The container divider herein described can be manufactured in a simple die-cut operation. The score lines can be appropriately placed during the die-cutting operation. Alternatively, after blank 10 has been die-cut from a foldable sheet material, the score lines independently can be provided.

Referring now more particularly to FIGS. 5–7, it can be seen that side support panel 40 is adapted to be folded upon front panel 30 and side support panel 50 is adapted to be folded upon front panel 20. In a preferred embodiment side edges 45 and 55 of side support panel 40 and 50, respectively, are formed of a greater length than side edges 22 and 33 of front panels 20 and 30. In that manner central portion 11 and rearward extension 12 are maintained in a spaced relationship from the top and bottom of side support members 40 and 50. Accordingly, when container divider 10 is inserted within a suitable container 60, for example, a regular slotted container, the resulting assembly is divided into two compartments, as shown in FIGS. 1 and 8. Tabular extensions 41, 42, 51 and 52 aid in supporting container divider 10 in that spatial configuration.

When container divider 10 is inserted into an appropriately sized container 60, front panels 20 and 30 and the bottom portion of side support panels 40 and 50 form inclined surfaces which aid in the retention of the curvature of the tubular articles stored therein. A resulting space is formed at free edge 13 between side support panels 40 and 50, which provides a convenient dispensing aperture for those articles. In order to prevent container divider 10 from being pulled forwardly out of container 60 when such tabular articles are dispensed, it is preferred to fold flaps 63 and 64 of container 60 inwardly upon support panels 40 and 50. Side flaps 63 and 64 thus exert a counter-force against container divider 10, which prevents its withdrawal from container 60 when the tubular articles are removed by a pulling operation.

In a particularly preferred embodiment of this invention, side edges 22 and 33 are made equal to sides 21 (*a*) and 31 (*a*) of side support panels 30 and 40 to divide container 60 into two equal compartments. Tab extensions 41, 42, 51 and 52 are preferably of triangular configuration. Top edge 32 of panel 30 is of the same dimension as fold line 43 on side support panel 40 and top edge 23 of front panel 20 is of the same dimension as fold line 54 on side support panel 50. It is apparent that the exact dimensions of the blank may be varied to fit the particular container in which it will be inserted.

The invention has been described with reference to the following drawings. However, they are meant as illustrations only and are not meant to limit the invention either in spirit or in scope as many variations in materials and methods will be apparent to those skilled in the art.

What is claimed is:

1. A blank of foldable sheet material comprising: a base panel defined by a free, front edge, a pair of connecting edges extending downwardly from the ends of said front edge and away from an axis of said base panel which is in the plane of said base panel and perpendicular to said front edge, a first pair of free, side edges extending downwardly from the ends of said connecting edges toward said axis of said base panel, a second pair of free, side edges extending from the ends of said first pair of said side edges downwardly from said front edge, and a free, rearward edge extending between the ends of said second pair of side edges;

a pair of rectangular, front panels foldably connected to said base panel along said connecting edges, each front panel having a side connecting edge which is a linear extension of one of said first, free side edges; and a pair of rectangular, side support panels foldably connected to said front panels along said side connecting edges of said front panels.

2. A blank as in claim 1 wherein said side support panels have laterally extending tabs foldably connected to an edge of said side support panel.

3. A container divider formed from a single sheet of foldable material comprising:

a base panel defined by a free, front edge, a pair of connecting edges extending downwardly from the ends of said front edge and away from an axis of said base panel which is in the plane of said base panel and perpendicular to said front edge, a first pair of free, side edges extending downwardly from the ends of said connecting edges toward said axis of said base panel, a second pair of free, side edges extending from the ends of said first pair of side edges downwardly from said front edge, and a free, rearward edge extending between the ends of said second pair of side edges;

a pair of rectangular, front panels foldably connected to said base panel along said connecting edges, each front panel having a side connecting edge which is a linear extension of one of said first, free edges when said front panels are in an unfolded configuration, said front panels in their folded configuration lying in a plane perpendicular to said base panel; and a pair of rectangular, side support panels foldably connected to said front panels along said side connecting edges of said front panels, said side support panels in their folded configuration being folded back upon said front panels and lying in the plane of said front panels.

4. A container divider as in claim 3, wherein the height of said side support panels is about twice the height of said front panels.

5. A container divider as in claim 4, wherein said side support panels have tabular extensions outwardly extending therefrom parallel to said central portion.

* * * * *